United States Patent [19]

Barella

[11] Patent Number: 4,901,866

[45] Date of Patent: Feb. 20, 1990

[54] CONCEALED COAT RACK APPARATUS

[76] Inventor: Edward M. Barella, 5741 W. 111th Ave., Broomfield, Colo. 80020

[21] Appl. No.: 304,537

[22] Filed: Jan. 31, 1989

[51] Int. Cl.[4] ..... A47B 53/00

[52] U.S. Cl. ..... 211/1.3; 211/100

[58] Field of Search ..... 211/1.3, 32, 87, 99, 211/100, 104, 13

[56] References Cited

U.S. PATENT DOCUMENTS

| | | | |
|---|---|---|---|
| 37,739 | 2/1863 | Devoe | 211/100 |
| 78,902 | 6/1868 | Stillman | 211/100 X |
| 2,317,437 | 4/1943 | Botta | 211/1.3 |
| 2,706,049 | 4/1955 | Andrews | 211/104 X |
| 3,289,989 | 12/1966 | Ferenz . | |
| 3,385,547 | 5/1968 | West . | |
| 3,941,250 | 3/1976 | Ott | 211/1.3 |
| 4,221,354 | 9/1980 | Kempkers . | |

FOREIGN PATENT DOCUMENTS

| | | | |
|---|---|---|---|
| 1307594 | 9/1962 | France | 211/1.3 |

*Primary Examiner*—Alvin C. Chin-Shue
*Assistant Examiner*—Sarah A. Lechok
*Attorney, Agent, or Firm*—Henderson & Sturm

[57] ABSTRACT

A concealed coat rack apparatus (10) including a housing member (13) and a plurality of pivoted support arms (21) wherein the housing member (13) is provided with a plurality of spaced face panel segments (19) and the support arms (21) are provided with a face panel (22) having a decorative pattern (20) (20') in the form of a pictorial representation such that the apparatus (10) will have the appearance of a conventional wall hanging.

1 Claim, 1 Drawing Sheet

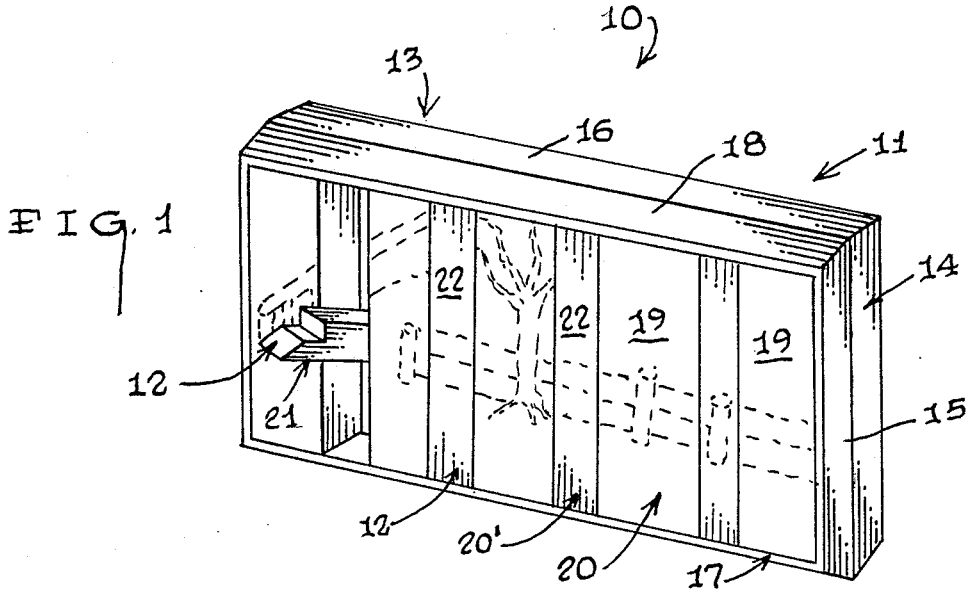
FIG. 1
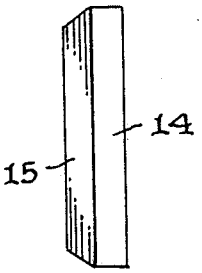
FIG. 4.
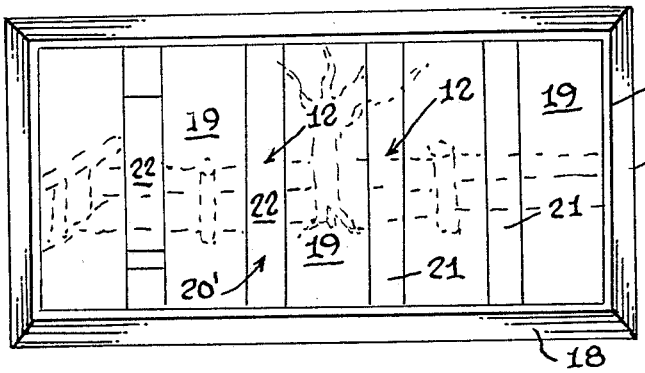
FIG. 2.
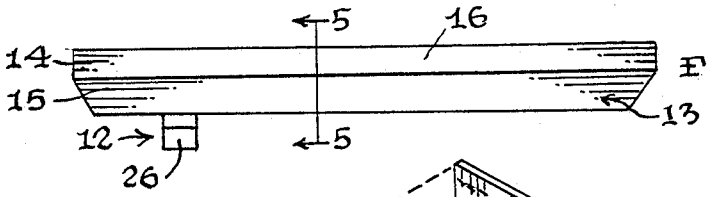
FIG. 3.
FIG. 5.
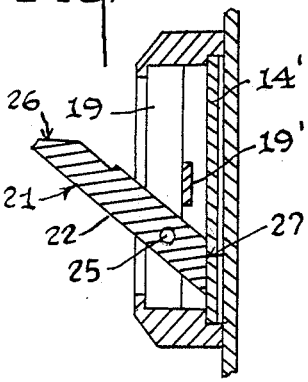
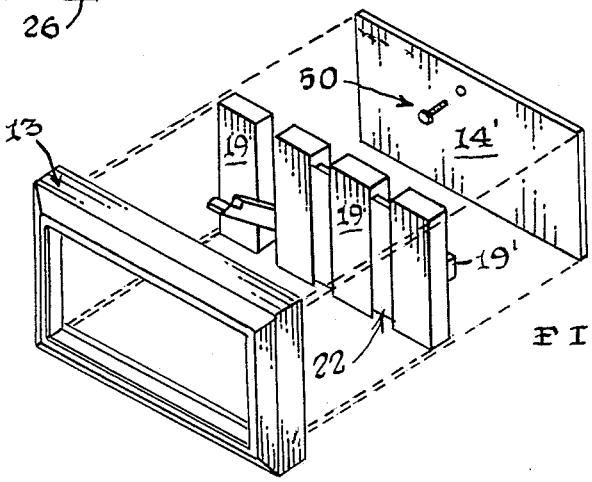
FIG. 6.

CONCEALED COAT RACK APPARATUS

TECHNICAL FIELD

The present invention relates generally to the field of coat rack devices, and more specifically to the area of concealed support hook arrangements.

BACKGROUND OF THE INVENTION

As can be seen by reference to the following U.S. Pat. No's.: 3,385,547; 3,941,250; 3,289,989; and 4,221,354 the prior art is replete with myriad and diverse suspension hook arrangements, including at least one reference wherein the suspension hook is concealable within a pattern imprinted on a wall surface.

While all of the aforementioned prior art constructions are more than adequate for the basic purpose and function for which they have been specifically designed, it is in the area that is broadly covered by the subject matter of U.S. Pat. No. 3,289,989 with which the present invention is concerned.

Broadly stated, the present invention is directed to providing a concealed support hook apparatus that is structurally independent and movable relative to any given wall surface; wherein the support hook apparatus will give the appearance of a non-functional wall hanging while not in use; and, only reveal its hidden utilitarian purpose at such time as the support hooks are required to be deployed.

Needless to say, there are currently a large number of individuals that find the presence of stationary support hooks prominently protruding from wall surfaces to be aesthetically displeasing, as well as, posing a potential capacity for inflicting physical injury to individuals that come into inadvertent contact with the outwardly projecting hooks.

As a consequence of the foregoing situation it is a stated objective of this invention to provide a concealed support hook apparatus that will overcome the aesthetic shortcomings and the practical utilitarian deficiencies that have plagued the prior art devices.

SUMMARY OF THE INVENTION

Briefly stated, the concealed coat rack apparatus that forms the basis of the present invention comprises a housing unit that is provided with a plurality of pivoted support units wherein both the face of the housing unit and the outer surfaces of the support unit are imprinted with a pattern such that the apparatus appears to be a pictorial wall hanging mounted on a deep frame.

As will be explained in greater detail further on in the specification, the pivoted support units are suspended with the housing unit in such a manner that when the upper portion of the support units are pivoted outwardly relative to the housing unit, the interior lower portion of the support units will abut against the interior of the housing unit to limit the travel of the individual support units.

As will also become evident from the remainder of the specification, the housing unit and the support units combine to provide an aesthetically pleasing apparently non-functional wall hanging whose true utilitarian purpose and function is not revealed until such time as required to fulfill that particular role.

BRIEF DESCRIPTION OF THE DRAWINGS

These and other objects, advantages and novel features of the invention will become apparent from the detailed description of the best mode for carrying out the preferred embodiment of the invention which follows, particularly when considered in conjunction with the accompanying drawings, wherein:

FIG. 1 is a perspective view of the concealed support hook apparatus of this invention;

FIG. 2 is a front plan view;

FIG. 3 is a top plan view;

FIG. 4 is a side plan view;

FIG. 5 is an enlarged cross-sectional view taken through line 5—5 of FIG. 3; and, FIG. 6 is an exploded perspective of the apparatus.

BEST MODE FOR CARRYING OUT THE INVENTION

As can be seen by reference to the drawings and in particular to FIG. 1, the concealed coat rack apparatus that forms the basis of the present invention is designated generally by the reference numeral (10). The apparatus (10) comprises in general: a housing unit (11) and a plurality of support units (12). These units will now be described in seriatim fashion.

As shown in FIGS. 2 thru 5, the housing unit (11) comprises a generally rectangular housing member (13) having a rear portion (14) and an angled front portion (15); wherein the rear portion (14) comprises a first generally rectangular framework element (16); and, the angled front portion (14) comprises a second reduced dimension rectangular framework element (17), and a plurality of inwardly angled wall segments (18) which are both operatively connected together, and which are connected on their individual opposed ends to both the first (16) and the second (17) rectangular framework elements.

In addition, the housing member (13) is further provided with a plurality of spaced face panel segments (19) which are operatively connected to the second rectangular framework element (17); wherein, the face panel segments (19) are imprinted with a decorative pattern (20) in the form of portions of a pictorial representation whose purpose and function will be described in greater detail further on in the specification.

Turning now to FIGS. 1 thru 3, and 5, it can be seen that the plurality of support units (12) comprise a plurality of generally trapezoidal support arms (21) having an elongated rectangular face panel (22) provided with a decorative pattern (20') which is a continuation of the pictorial representation which appears on the face panel segments (19) on opposite sides of each of the support arms (21); such that the face panels (22) of the support arms (21) and the face panel segments (19) of the housing member (13) form a complete pictorial representation such as would be found on a painting, print, photograph or the like..

As can best be seen by reference to FIGS. 4 and 5, each of the support arms (21) are pivotally secured as at (25) to the housing member (13) such that the face panels (22) of the support arms (21) will be disposed generally flush with the front of the housing member (13) in one mode of operation. In addition, as can be seen particularly by reference to FIG. 5, the truncated top and bottom surfaces of the trapezoidal support arms (21) are configured such as to form a hook member (26) at the top of each support arm (21) and a stop member (27) at the bottom of each support.

Still referring to FIG. 5, it can be seen that when a selected support arm (21) is pivoted outwardly to expose the hook member (26), the stop member (27) will be pivoted into contact with a vertical wall surface of the rear portion (14') of the housing member (13). In addition as shown in FIGS. 5 and 6 the face panel segments (19) are operatively secured to one another by a firring strip (19') which extends across the rear of each of the face panel segments (19) in a well recognized fashion.

It should further be appreciated that the housing member (13) is also intended to be provided with suitable securing means (not shown); such that the apparatus (10) may be suspended and/or attached to a vertical wall (100) in the manner of a conventional wall hanging.

By now it should be apparent that the concealed coat rack apparatus (10) of this invention appears to the casual observer as a conventional wall hanging when the support units (12) are deployed within the housing unit (11) in their inoperative mode; and, the true utilitarian nature of this apparatus (10) will not be revealed until one or more of the support arms (21) is pivoted outwardly relative to the housing member (13).

Having thereby described the subject matter of this invention it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A concealed coat rack apparatus that gives the appearance of a conventional wall hanging when not in use wherein the apparatus consists of:

a housing unit including a housing member having a plurality of vertically disposed spaced free panel segments having a decorative pattern in the form of portions of a pictorial representation; and, a plurality of support units including a plurality of generally trapezoidal support arms pivotally secured to said housing member and having an elongated rectangular face panel provided with a decorative pattern which matches the decorative pattern on the spaced face panel segments on said housing member; wherein each of the generally trapezoidal support arms have an angled top and bottom surface; wherein, the top surface forms a hook member and wherein the bottom surface forms an angled stop member; and, wherein the housing member is provided with an interior vertical wall surface and the angled stop member on each of the support arms is adapted to come into contact with said interior vertical wall surface to limit the pivotal movement of the support arms relative to the housing member and to deploy the support members at an upwardly inclined angle relative to said vertically disposed face panel segments.

* * * * *